US010383446B2

(12) United States Patent
Schmitz et al.

(10) Patent No.: US 10,383,446 B2
(45) Date of Patent: Aug. 20, 2019

(54) CHAIR

(71) Applicant: Herman Miller, Inc., Zeeland, MI (US)

(72) Inventors: Johann Burkhard Schmitz, Berlin (DE); Claudia Plikat, Berlin (DE); Carola E. M. Zwick, Berlin (DE); Roland R. O. Zwick, Berlin (DE)

(73) Assignee: HERMAN MILLER, INC., Zeeland, MI (US)

( * ) Notice: Subject to any disclaimer, the term of this patent is extended or adjusted under 35 U.S.C. 154(b) by 189 days.

(21) Appl. No.: 15/370,994

(22) Filed: Dec. 6, 2016

(65) Prior Publication Data

US 2017/0079439 A1 Mar. 23, 2017

Related U.S. Application Data

(63) Continuation of application No. 13/703,527, filed as application No. PCT/EP2011/002908 on Jun. 14, 2011, now Pat. No. 9,510,684.

(30) Foreign Application Priority Data

Jun. 15, 2010 (DE) ..... 10 2010 023 787

(51) Int. Cl.
*A47C 7/44* (2006.01)
*A47C 1/032* (2006.01)

(52) U.S. Cl.
CPC ..... *A47C 7/44* (2013.01); *A47C 1/03255* (2013.01); *A47C 1/03288* (2013.01)

(58) Field of Classification Search
CPC ..... A47C 7/44; A47C 1/03255
USPC ..... 297/296, 297, 300.2, 302.1, 321
See application file for complete search history.

(56) References Cited

U.S. PATENT DOCUMENTS

| | | | |
|---|---|---|---|
| 2,273,980 | A | 2/1942 | Moody |
| 3,133,765 | A | 5/1964 | Kramer |
| 4,451,085 | A | 5/1984 | Franck et al. |
| 5,195,801 | A | 3/1993 | Franck et al. |
| 5,314,240 | A | 5/1994 | Ishi et al. |

(Continued)

FOREIGN PATENT DOCUMENTS

| | | |
|---|---|---|
| DE | 1282262 | 11/1968 |
| DE | 4023607 | 1/1992 |

(Continued)

OTHER PUBLICATIONS

International Search Report for International Application No. PCT/EP2011/002908, dated Oct. 6, 2011, 3 pages.

(Continued)

*Primary Examiner* — Timothy J Brindley
(74) *Attorney, Agent, or Firm* — Michael Best & Friedrich LLP

(57) ABSTRACT

A chair includes a base, a support element and a torsion element. The support element is coupled to the base and includes a seat region, a backrest region and a transition region connecting the seat region and the backrest region. The backrest region is reclinable relative to the seat region by way of elastic deformation of the support element. The torsion element is coupled to the base and to the backrest region. The torsion element controls the reclining of the backrest region relative to the seat region. The support element is exclusively connected to the torsion element above a lumbar region, wherein the backrest region can be inclined and/or twisted in relation to the seat region.

20 Claims, 15 Drawing Sheets

(56) References Cited

U.S. PATENT DOCUMENTS

Figure 2:
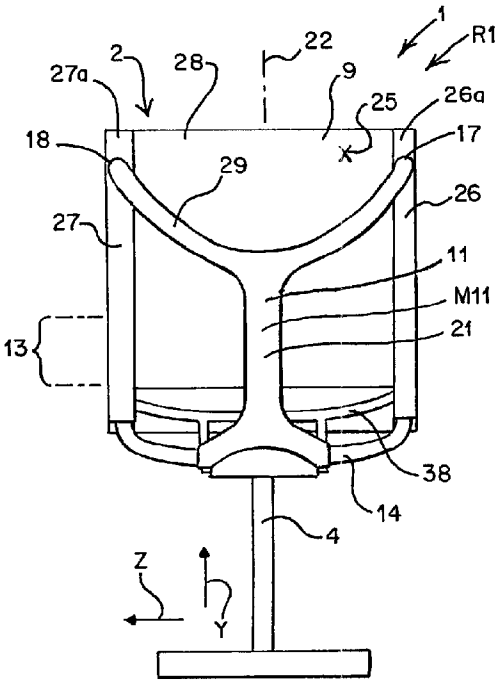

| | | | |
|---|---|---|---|
| 5,348,372 | A | 9/1994 | Takamatsu et al. |
| 5,385,388 | A | 1/1995 | Faiks et al. |
| 6,439,661 | B1 | 8/2002 | Brauning |
| 6,523,896 | B1 | 2/2003 | Uhlenbrock |
| 6,945,605 | B2 | 9/2005 | Kinoshita et al. |
| 7,066,537 | B2 | 6/2006 | Coffield et al. |
| 7,712,833 | B2 | 5/2010 | Ueda |
| 7,775,601 | B2 | 8/2010 | Wu |
| 2003/0107252 | A1 | 6/2003 | Kinoshita et al. |
| 2004/0140701 | A1 | 7/2004 | Schmitz et al. |
| 2007/0108831 | A1 | 5/2007 | Ueda |
| 2007/0290537 | A1 | 12/2007 | Lin |
| 2008/0169693 | A1 | 7/2008 | Becker et al. |
| 2009/0146476 | A1 | 6/2009 | Kan et al. |
| 2010/0117422 | A1 | 5/2010 | Ueda |

FOREIGN PATENT DOCUMENTS

| | | |
|---|---|---|
| DE | 4216159 | 11/1993 |
| EP | 0049310 | 4/1982 |
| EP | 0815778 | 2/1998 |
| EP | 1327400 | 7/2003 |
| EP | 1785068 | 5/2007 |
| EP | 1915925 | 4/2008 |
| EP | 1946676 | 7/2008 |
| EP | 2100539 | 9/2009 |
| EP | 2110050 | 10/2009 |
| FR | 2509160 | 1/1983 |
| JP | S57-64014 | 4/1982 |
| JP | H04-101652 | 9/1992 |
| JP | H5-91931 | 4/1993 |
| JP | 2007-117537 | 5/2007 |
| JP | 2007-146866 | 6/2007 |
| JP | 2008-229379 | 10/2008 |
| JP | 2009-165660 | 7/2009 |
| WO | 0191614 | 12/2001 |
| WO | 2011/130264 | 10/2011 |

OTHER PUBLICATIONS

International Preliminary Report on Patentability for International Application No. PCT/EP2011/002908, dated Dec. 19, 2012, 7 pages.

Office Action issued in Singaporean Patent Application No. 2012091039, dated Jan. 12, 2015, 20 pages.

Office Action issued in Japanese Patent Application No. 2013-514580, dated Mar. 2, 2015, 5 pages.

Office Action issued in Australian Patent Application No. 2011267475, dated Mar. 13, 2015, 5 pages.

1a
R1
α-R1
53a
53
54
56
50
B50
9
52a
52
19
2
10
8
23
12,38
41
4
X
Y
B51
51
B-R1
55
11
3
14
22
α-R2
50,B51
B-R2
X'
Y'
28
26
29,56
B51
27

30a
R1
α-R1
53a
53
54
56
50,B50
9
52
52a
19
10
8
2
41
4
3
14
11
55
B51,51
B-R1
R2
α-R2
B51
51
B-R2
Y'
X
X'
22
28
26
27
56,29
B51,51
50
B50

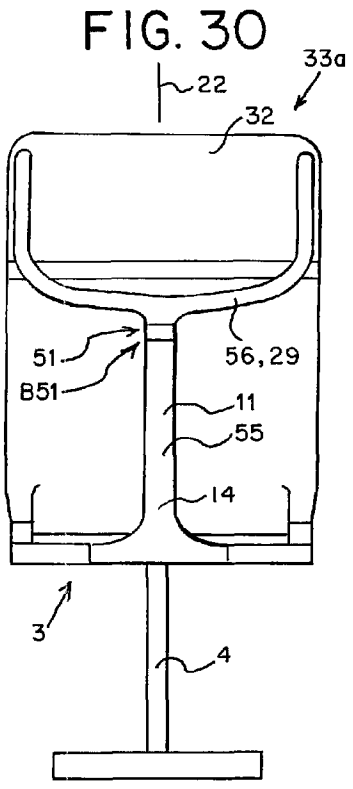
FIG. 30
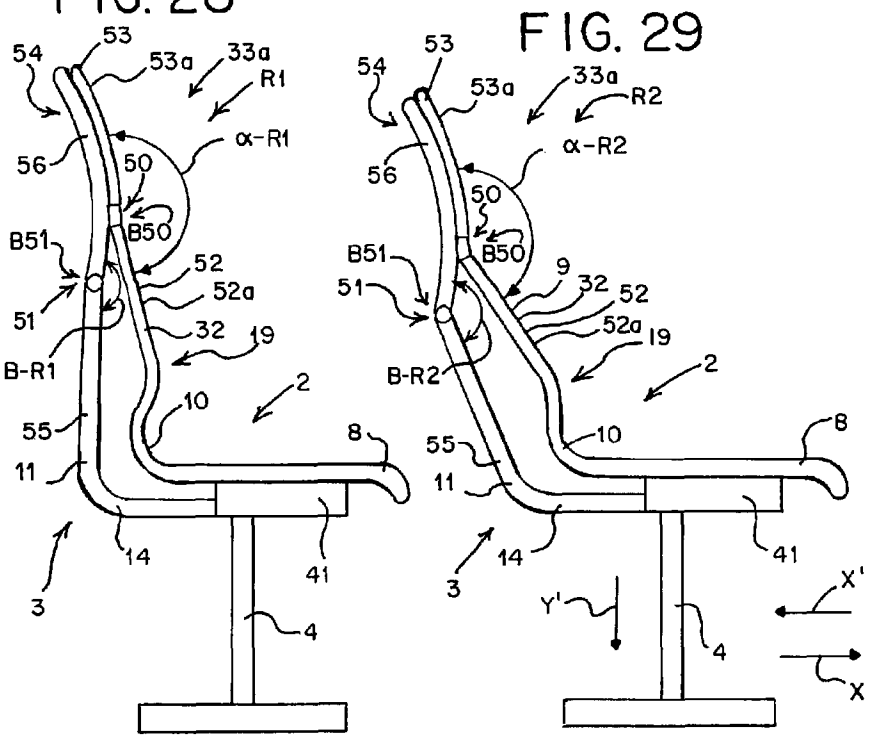
FIG. 29
FIG. 28

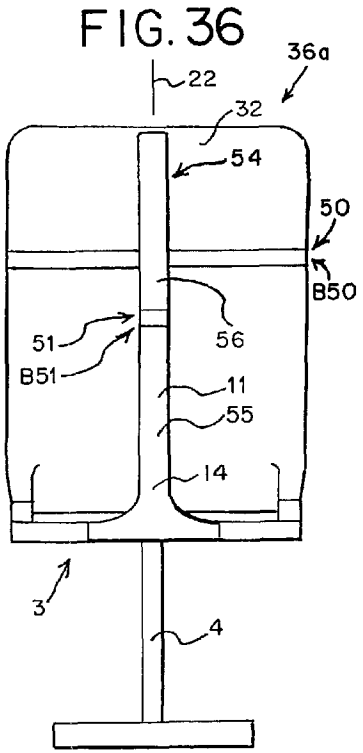
FIG. 36
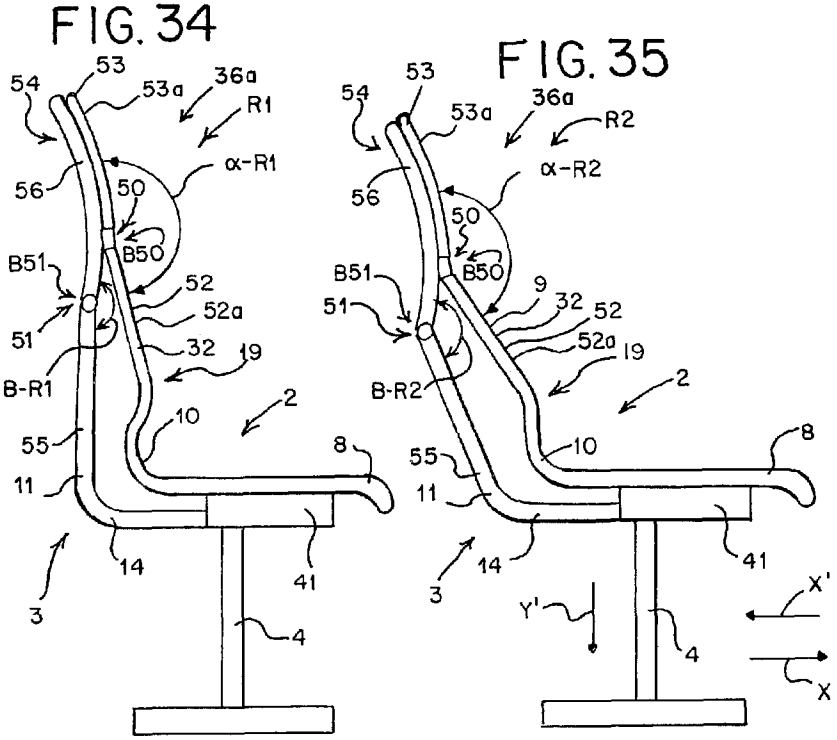
FIG. 35
FIG. 34

CHAIR

This application is a continuation of U.S. patent application Ser. No. 13/703,527, filed Dec. 11, 2012, now U.S. Pat. No. 9,510,684, which is a national stage entry of International Application No. PCT/EP2011/0002908, filed Jun. 14, 2011, which claims priority to German Application No. 102010023787.6, filed Jun. 15, 2010, the entire disclosures of which are incorporated herein by reference.

The invention relates to a chair which comprises a permanent support element, a movement mechanism and a frame.

Disclosed in DE 1 282 262 A1 is a chair comprising a permanent support element which is configured as a seat shell, the rear region of the seat shell being supported in a lumbar region by a centrally arranged double tube.

Disclosed in EP 0 049 310 B1 is a chair comprising a permanent support element, the rear region thereof being supported and cushioned by arms arranged laterally adjacent to the support element.

Disclosed in EP 1 946 676 A1 is a chair comprising a permanent support element which is configured as a seat shell, the rear region being supported and cushioned in a lumbar region by two supporting arms arranged laterally and symmetrically.

Disclosed in EP 2 110 050 A1 is a chair which comprises a permanent support, which comprises two L-shaped support members, which bear a cover, the support being borne in a transition region and a rear region by a rigid rear element which is incorporated in the support.

It is the object of the invention to develop a chair comprising a permanent, lightweight support element which has enhanced seating comfort and which is of lightweight construction.

This object is achieved by the characterizing features of Claim 1 based on the features of the preamble of Claim 1. Advantageous and expedient developments are set forth in the sub-claims.

In the chair according to the invention, the movement mechanism comprises a torsion element which bears the rear part and controls the inclination of the rear part, the rear part of the support element being exclusively connected above the lumbar support to the torsion element. Due to the support of the rear region of the support element via a torsion element and the articulation of the rear region of the support element in an upper half of the rear region on the torsion element, a lower inherent stability of the rear region of the support element is required, as said support element is borne and stabilized in its upper rear region by the torsion element. This is very advantageous, in particular, as torsional forces are introduced by the user precisely in this upper rear region, in particular via their shoulder blades, when the user seated on the chair leans back to the right or to the left, in order to grasp, for example, a file located to the rear. As a result of the close vicinity between the points of force introduction in the region of the shoulder blades of the user seated on the support element of the chair and the point(s) of articulation of the torsion element in the upper half of the rear region of the support means, stresses are substantially prevented from being formed in the rear element, so that said rear element may be configured as an element of lightweight construction. As a result of this lightweight construction which permits the specific arrangement and attachment of the torsion element, it is also possible to ensure the required relative movement, which occurs when the loading of the chair is altered by the seated user, by means of elastic deformation of the support element between the rear region and the seat region, without having to implement costly technical measures for this purpose.

According to the invention, in the chair, the rear region can be inclined and/or can be twisted in relation to the seat region from an upright seated position into a reclined seated position, a force which is introduced into the support element by a seated person and which causes bending up of the support element and/or rotation of the rear part in relation to the seat part experiencing a counterforce by the movement mechanism, the movement mechanism being connected to the support element in the rear region above a lumbar support, in particular in a central point of articulation or in particular in two lateral points of articulation, and the movement mechanism being connected in particular fixedly to the support element in the seat region, or being connected in particular via two rotational axes arranged in the seat region. By means of such a connection of the support element, which bears the seated person, to the movement mechanism, the requirement of enabling the seated person to rotate his/her body when sitting upright and when reclining is optimally met. The rear part of the chair can optimally follow the rotation of the person's body, since the movement mechanism is designed in the region of the transition part and in the lower half of the rear part in a manner similar to the person's spine as a rotatable structure which lies in the plane of symmetry.

The invention also provides to equip the torsion element with a torsion rod which extends upwards beyond the lumbar support in a vertical plane of symmetry of the chair. As a result, the torsion rod is optimally oriented relative to asymmetrical loads of the rear region of the support element, which may be produced by a rotation of the upper body of a person seated on the chair.

According to the invention, the elastic deformation of the support element between the rear region and the seat region is also achieved, in particular, by eliminating a connection of the support element to the movement mechanism in a lower rear region and in a transition region.

According to the invention, the support element comprises, according to a first variant, two curved, L-shaped support members and a cover, the cover being tensioned between the support members. Such a structure results in a simple manner in a lightweight construction of the support element.

The invention also provides to arrange the movement mechanism between the frame and the support element, the movement mechanism bearing both the rear part of the support element and the seat part of the support element, an inclination of the seat part and an inclination of the rear part being controlled by the movement mechanism, depending on the forces to which the chair is subjected by a seated person, the inclination of the seat part and the inclination of the rear part being controlled in a mutually dependent manner and the inclination of the rear part between an initial position and an end position increasing to a greater extent than the inclination of the seat part. As a result of such a movement mechanism, a particularly high degree of seating comfort is achieved.

According to a further variant, the invention provides that the support element is configured as a curved, L-shaped seat shell. A seat shell thus configured is able to be produced in a particularly simple manner in terms of production technology, for example as a one-piece injection-molded part.

In a simple variant the invention provides to fix the support element in its seat region rigidly to the frame and to support by means of the torsion rod just one cantilever arm, which consists of the transition region and the rear region of the support element. Such a chair which has a high degree of seating comfort has a particularly simple movement mechanism and, therefore, may be produced easily and thus cost-effectively.

Furthermore, the invention provides a parallel extent of the two rotational axes arranged in the seat region, the rotational axes orthogonally penetrating a vertical plane of symmetry of the chair. By mounting the seat part on the rotational axes, the seat part is stabilized by the movement mechanism and defines the movement profile of the seat part.

According to the invention, the counterforce which is produced by the movement mechanism to compensate for the force introduced by a seated person amounts to at least 50% and in particular at least 70% of a required total counterforce, the remaining counterforce being produced by the deforming support element. By this means, the support element is greatly relieved of load and can thus be configured to be correspondingly lightweight and flexible.

Furthermore, the invention provides to arrange the movement mechanism between the frame and the support element, the movement mechanism comprising a first rocker, a second rocker and a basic body, the second rocker being articulated rotatably on the basic body and rotatably on a front half of the seat part, the first rocker being articulated rotatably on the basic body, and being articulated rotatably on a rear half of the seat part and comprising the torsion element which is connected to the rear region above a lumbar support. By means of such an articulation and a mirror-symmetrical and rigid configuration of each of the two rockers with respect to the plane of symmetry, the inclination behavior and the torsion behavior of the chair can be realized with few structural elements.

Alternatively, the invention also provides to equip a movement mechanism, which is arranged between the frame and the support element, with a bearing element which can in particular be elastically deformed, the bearing element being arranged between the frame and the seat part and fixing the seat part, and the movement mechanism comprising an elastically deformable rocker which comprises the torsion element and is connected to the frame and to the rear region above a lumbar support. By means of such a configuration of the chair, the chair has the desired inclination behavior and the desired torsion behavior even without a movement mechanism articulated by rotational joints.

According to the invention, the support element also comprises two spacer rods, the two support members both being held at a predefined distance by the two spacer rods, which connect free ends of the support members, and being held parallel to each other at said defined distance by the movement mechanism. By means of such a construction of the support element as a closed frame, it is possible to tension the cover thereof with high tensioning forces, the support element also being stiffened by the movement mechanism and the articulation thereof on the bearing element.

According to the invention, it is provided to damp the movement mechanism by at least one spring mechanism or a resilient element. By this means, in particular with an adjustable spring mechanism or an exchangeable resilient element, the inclination and/or torsion behavior of the chair can be adjusted to the person using the chair.

According to the invention, it is provided to connect the seat part to the movement mechanism by a four-point bearing at four points of articulation, and to connect the rear part to the movement mechanism in particular by a two-point bearing, in particular at support members together with an upper half of the rear part, in particular at two points of articulation. By means of a four-point articulation of the seat part and a rigid coupling of the left and right halves of the movement mechanism, which halves are divided by the plane of symmetry, the seat part is fixed to an inclining movement and an undesirable rolling of the seat part about a roll axis lying the plane of symmetry is prevented. At the points at which the forces are introduced by the chair user, a two-point articulation of the rear part affords optimum support of the rear part by means of the movement mechanism.

Finally, it is provided to configure the rear part with a first buckling device, a lower section of the rear part, which section adjoins the transition part, and an upper section of the rear part, which section adjoins the lower section, being pivotably connected by the first buckling device, the first buckling device being formed below a region of articulation, in which the torsion element is articulated on the rear part, the torsion element comprising a second buckling device, a lower section of the torsion element, which section is articulated on a basic body of the movement mechanism, and an upper section of the torsion element, which section is articulated on the rear element, being pivotably connected by the second buckling device, the second buckling device being formed above the lumbar support. By the chair according to the invention being supplemented in this manner by two buckling devices, the chair can be supplemented by a further function while retaining the described properties thereof. Said additional function is provided in particular for chairs with a high back rest which reaches into the neck region or into the head region of a person seated on the chair. In this case, as a result of the special arrangement of the buckling devices, the upper section of the rear element tips forwards if a person seated in the chair leans back against the rear part, and thus assists the seated person in maintaining an approximately horizontal viewing axis if the person, for example, wishes to continue to keep a monitor in view even when the person is leaning back.

Further details of the invention are disclosed in the drawings, with reference to exemplary embodiments shown schematically.

Figure 1:
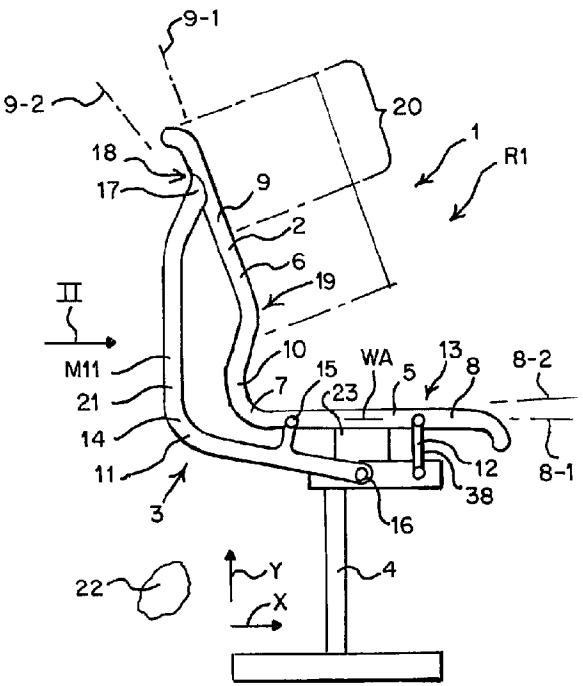
Figure 4:
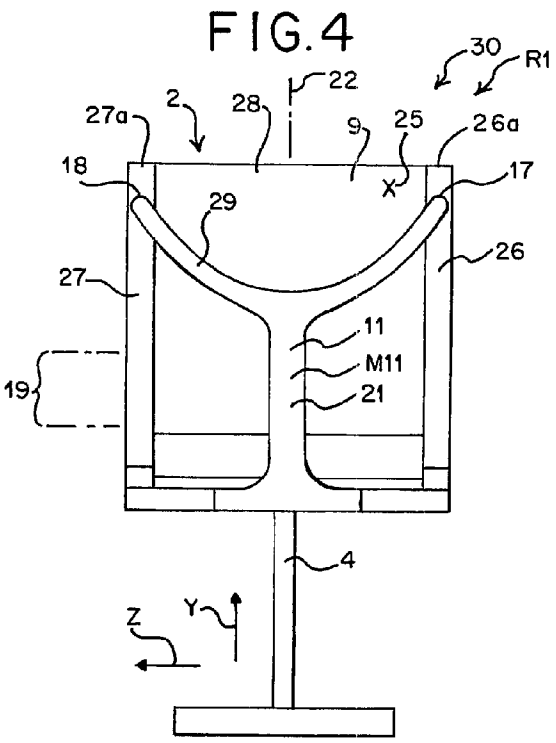
Figure 3:
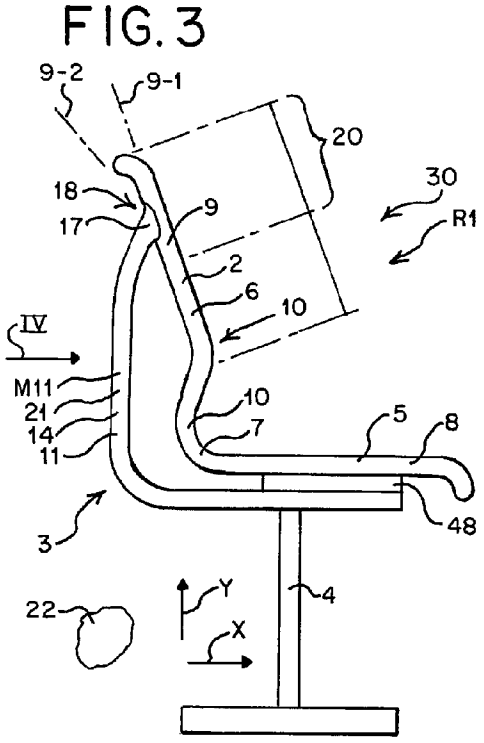
Figure 6:
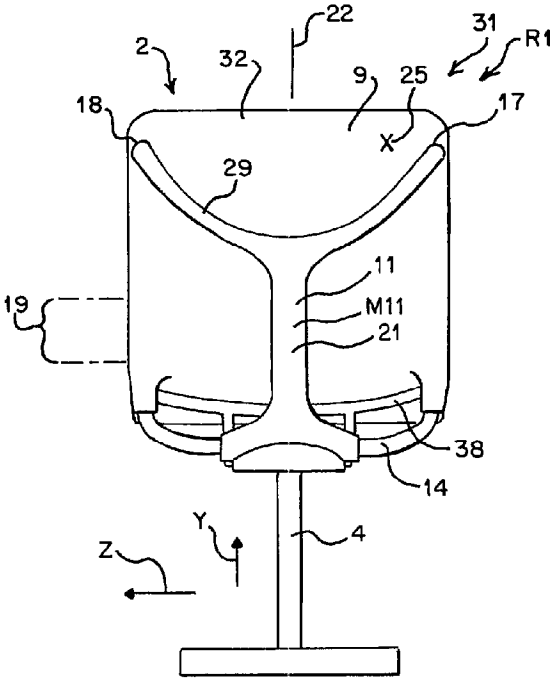
Figure 5:
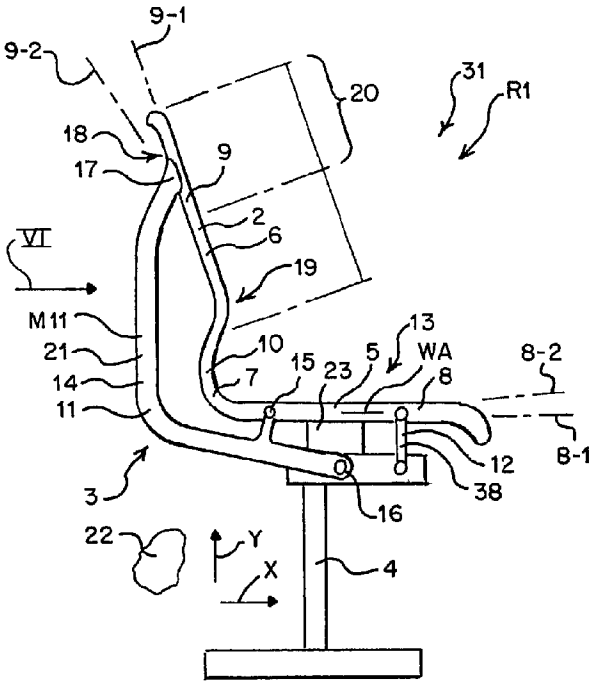
Figure 8:
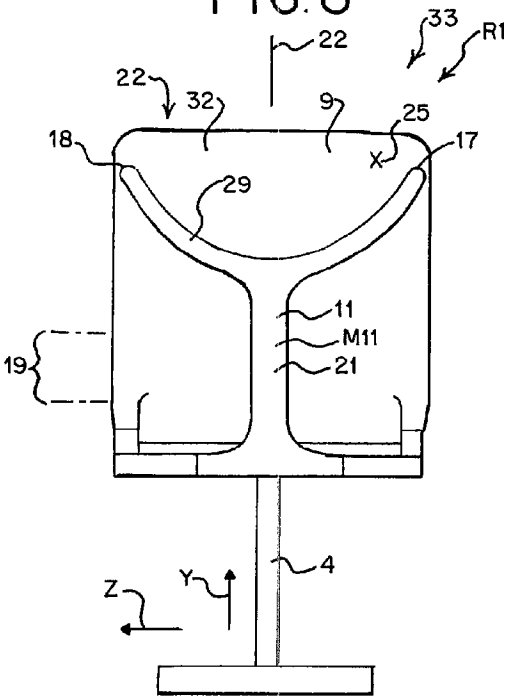
Figure 7:
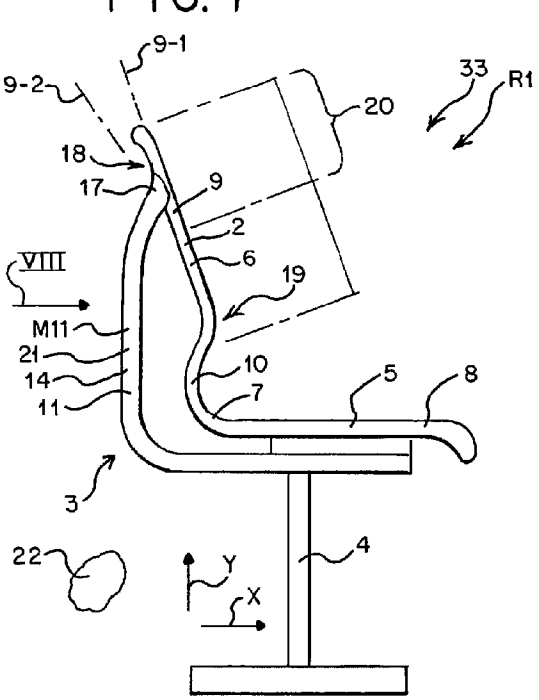
Figure 10:
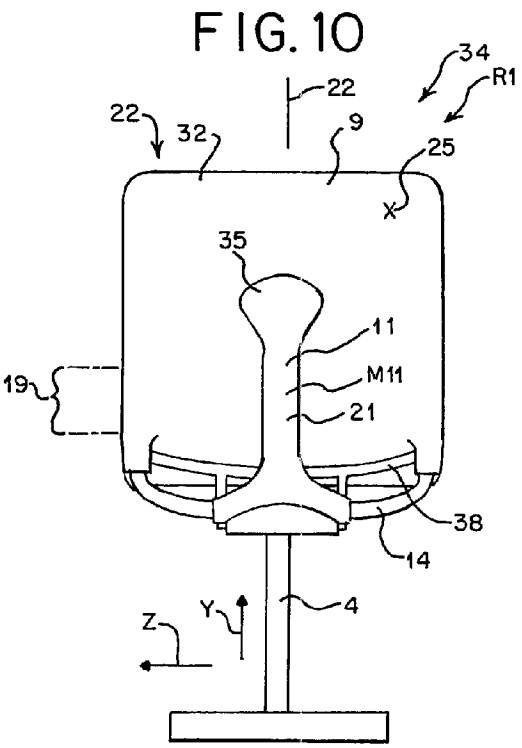
Figure 9:
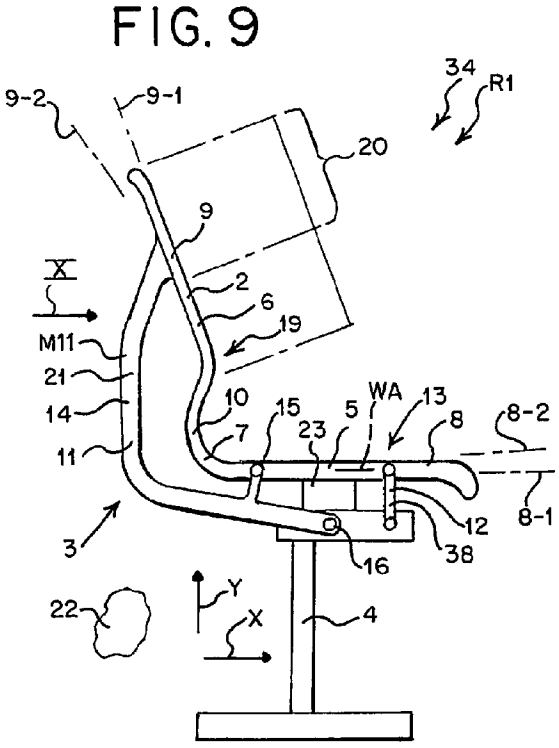
Figure 12:
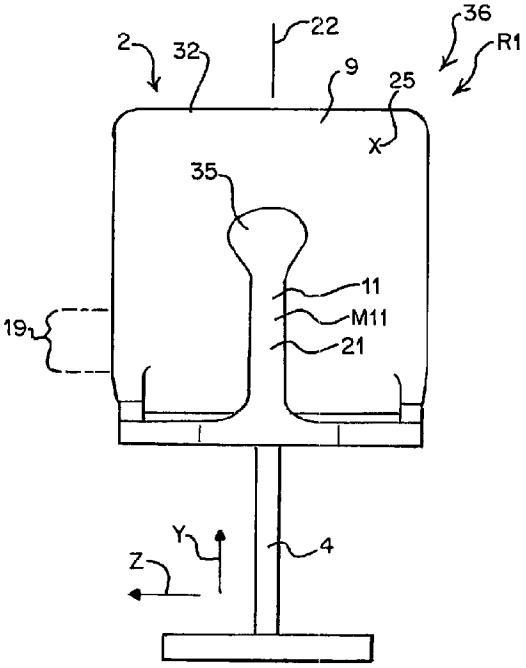
Figure 11:
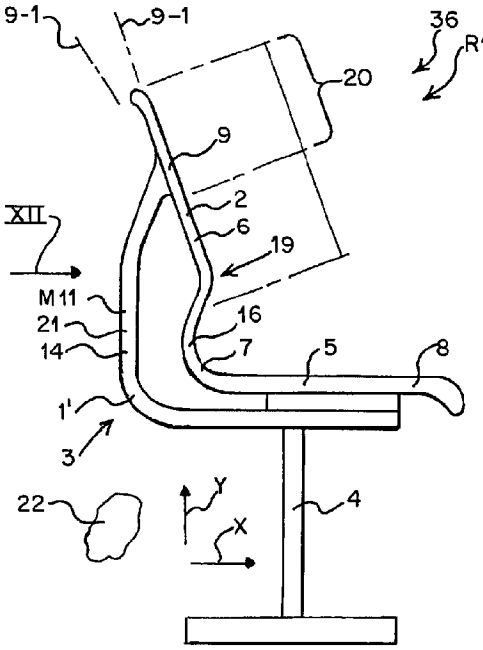
Figure 15:
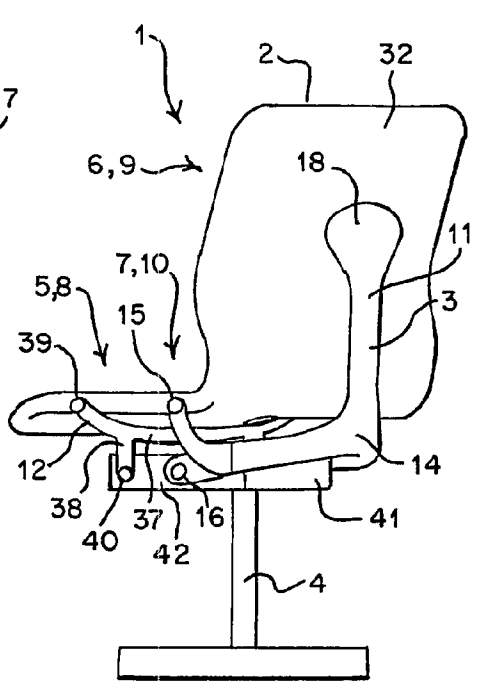
Figure 14:
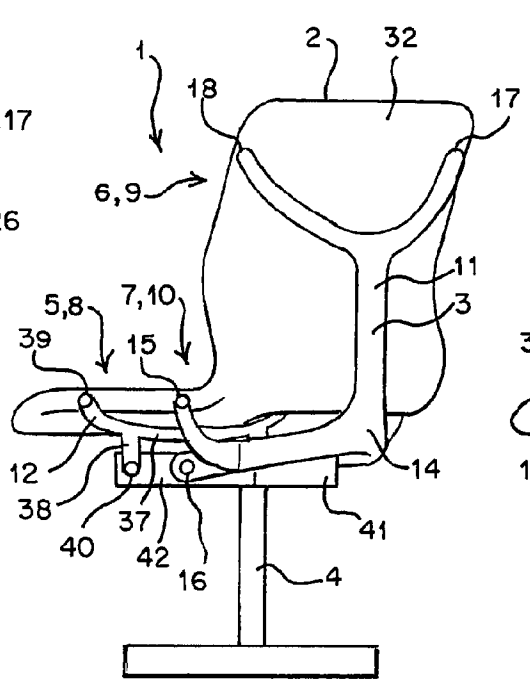
Figure 13:
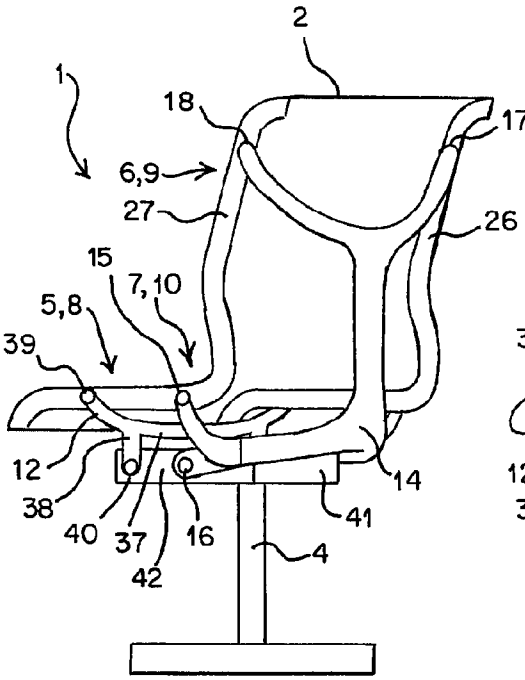
Figure 16:
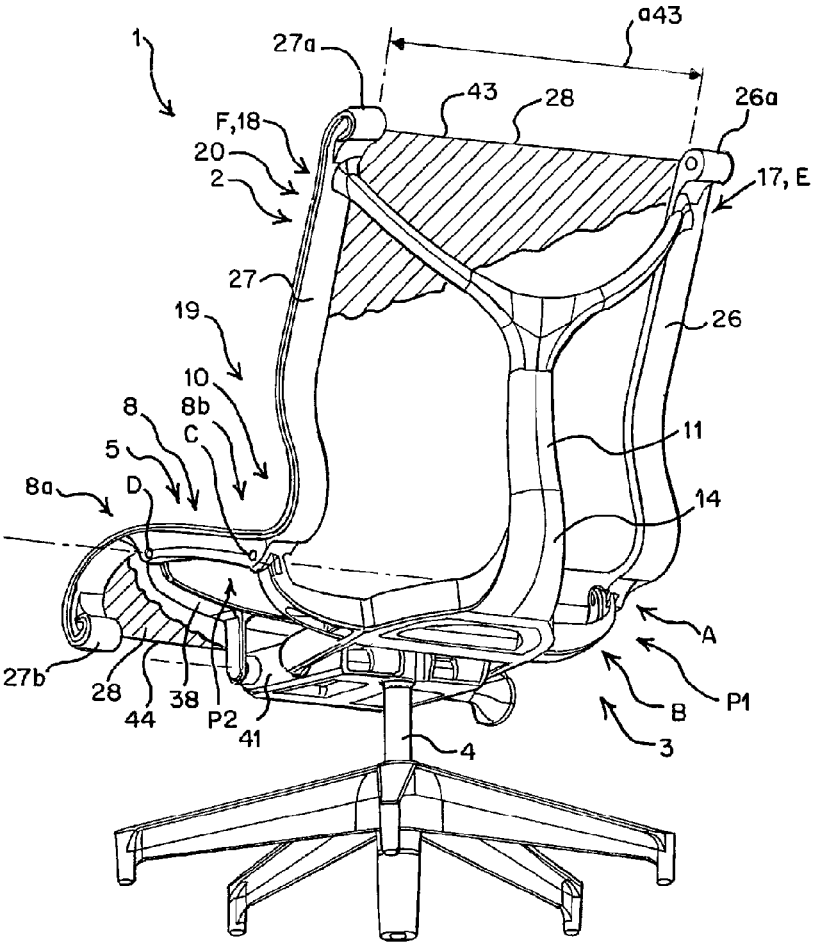
Figure 18:
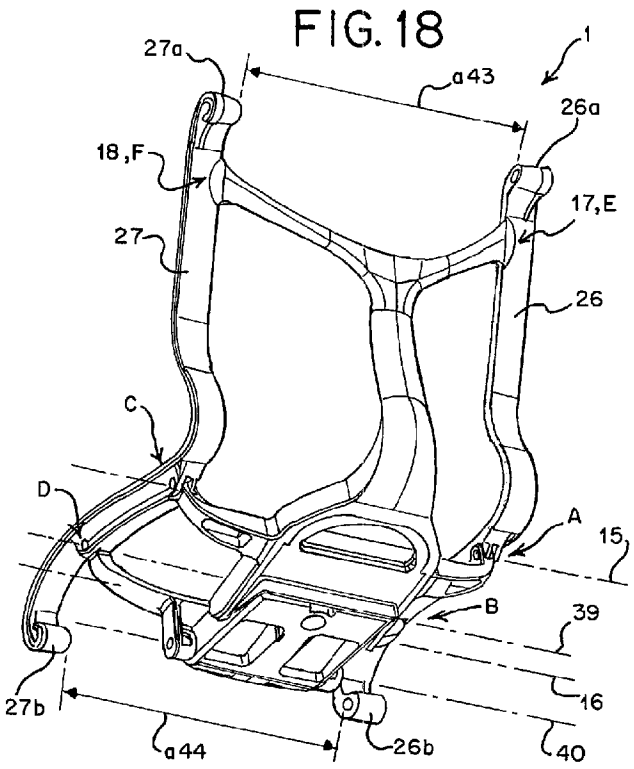
Figure 17:
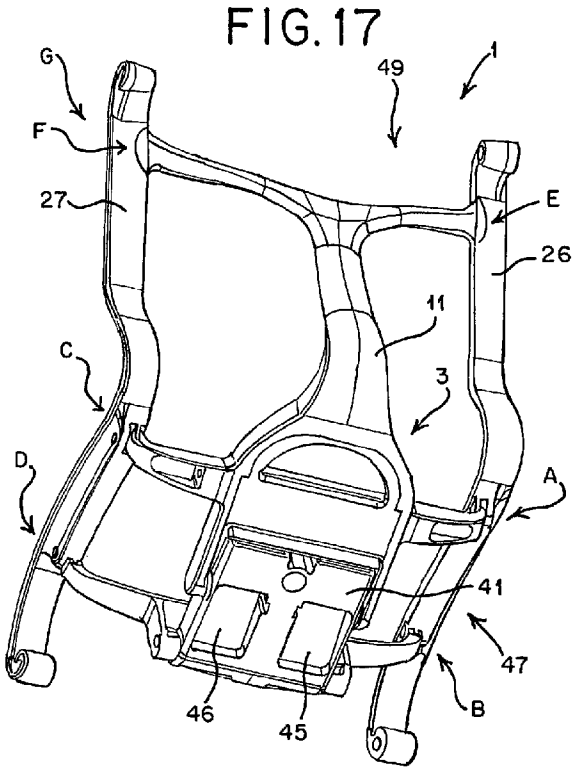
Figures 19, 20, 21:
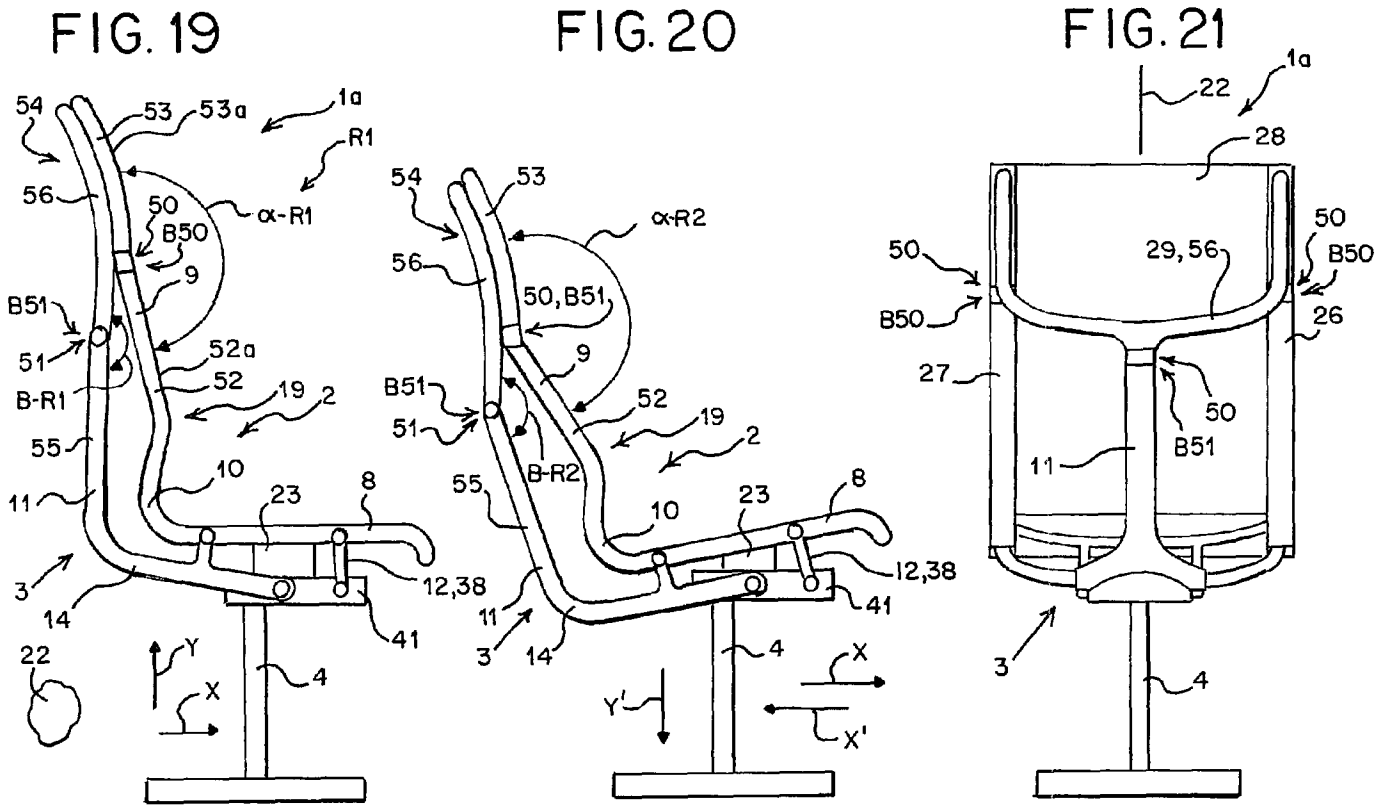
Figures 22, 23, 24:
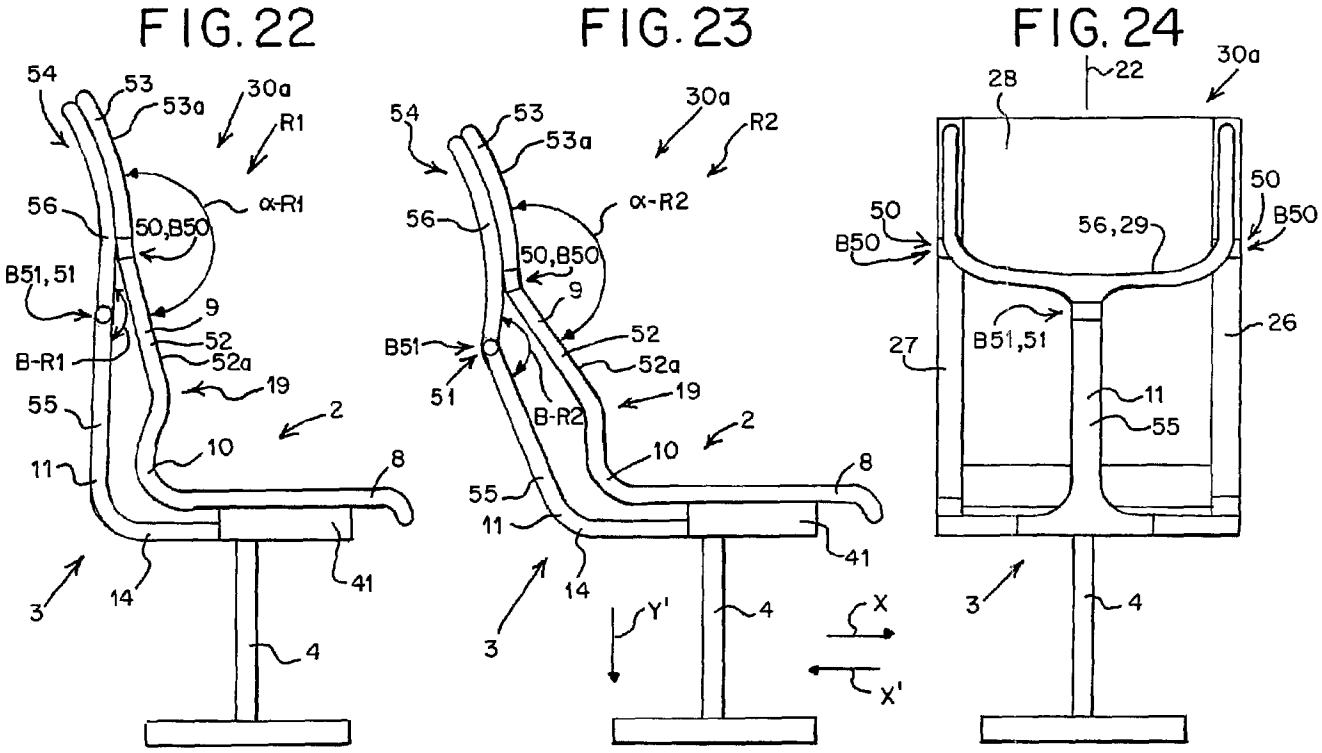
Figure 27:
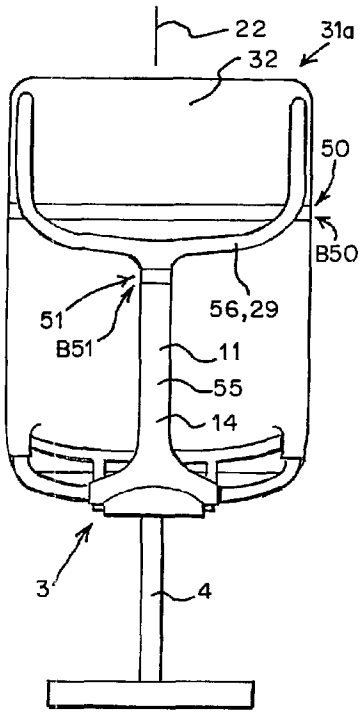
Figure 26:
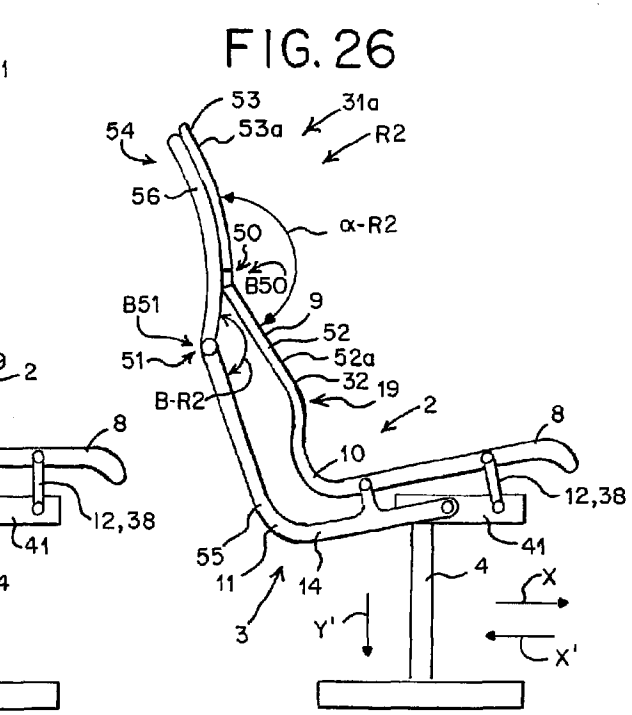
Figure 25:
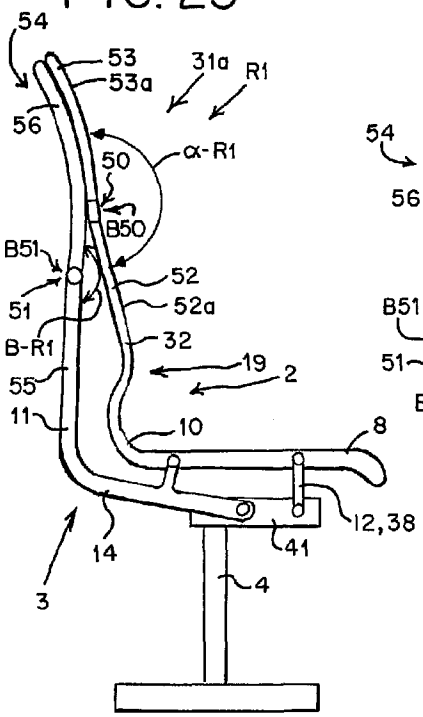
Figure 33:
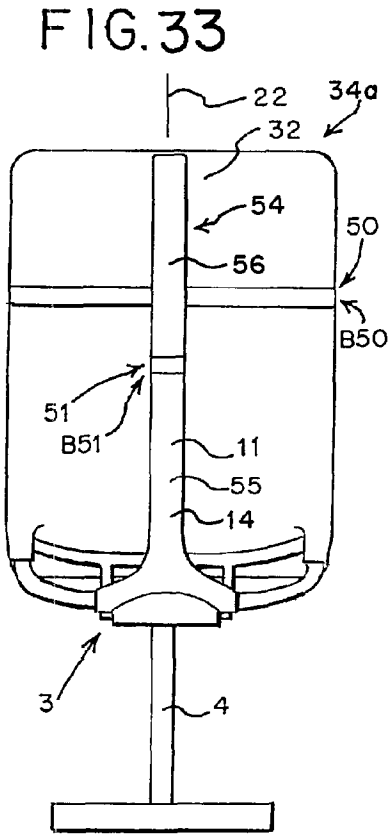
Figure 32:
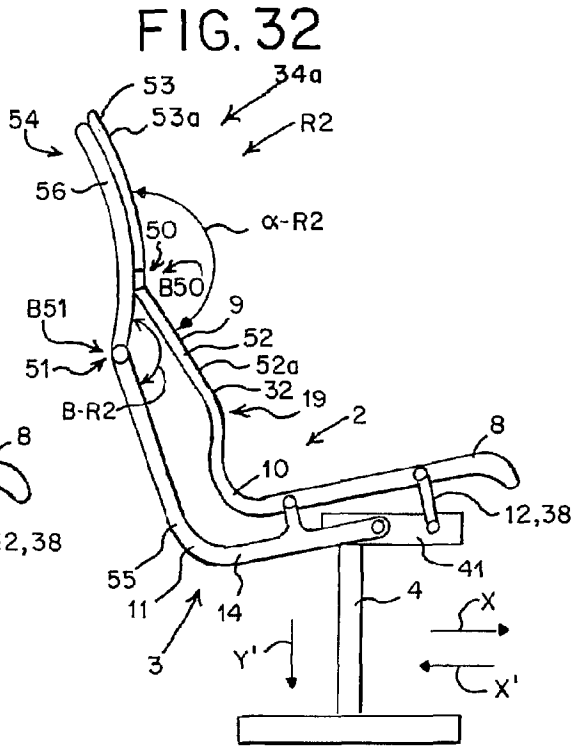
Figure 31:
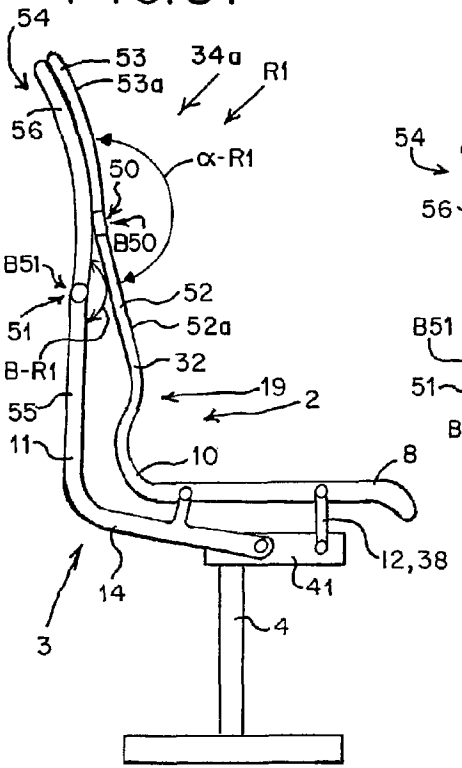

In the drawings:

FIGS. 1 and 2: show a side view and a rear view of a first variant of a chair according to the invention;

FIGS. 3 and 4: show a side view and a rear view of a second variant of a chair according to the invention;

FIGS. 5 and 6: show a side view and a rear view of a third variant of a chair according to the invention;

FIGS. 7 and 8: show a side view and a rear view of a fourth variant of a chair according to the invention;

FIGS. 9 and 10: show a side view and a rear view of a fifth variant of a chair according to the invention;

FIGS. 11 and 12: show a side view and a rear view of a sixth variant of a chair according to the invention;

FIGS. 13-15: each show an oblique view of the first, third and fifth variant;

FIG. 16: shows a perspective illustration of the first variant with deconstructed details;

FIGS. 17, 18: show further views of the chair shown in FIG. 16, with the frame removed;

FIGS. 19-21: show modifications of the first variant in two side views and a rear view;

FIGS. 22-24: show modifications of the second variant in two side views and a rear view;

FIGS. 25-27: show modifications of the third variant in two side views and a rear view;

FIGS. 28-30: show modifications of the fourth variant in two side views and a rear view;

FIGS. 31-33: show modifications of the fifth variant in two side views and a rear view, and FIGS. 34-36: show modifications of the sixth variant in two sides views and a rear view.

In FIG. 1 a first variant of a chair 1 is shown in side view. The chair 1 comprises a permanent support element 2, a movement mechanism 3 and a frame 4. The support element 2 comprises a seat region 5, a rear region 6 and a transition region 7. In this case, the seat region 5 forms a seat part 8, the rear region 6 a rear part 9 and the transition region 7 a transition part 10 of the support element 2. The movement mechanism 3 comprises a torsion element 11 and two front levers 12 and 13, the second front lever 12 being concealed by the first front lever 12 in the view of FIG. 1. The torsion element 11 is configured as a first rocker 14, which is connected about a rotational axis 15 in the manner of a rotary joint to the seat part 8 and about a rotational axis 16 in the manner of a rotary joint to the frame 4. The two front levers 12, 13 are configured as a second rocker 38 as a single component. Furthermore, the torsion element 11 is connected at two fastening points 17 and 18 to the rear part 9. Viewed in the y-direction, the fastening points 17 and 18 are located above a lumbar support 19 of the rear part 9 in an upper half 20 of the rear part 9. A central part M11 of the torsion element 11 is configured as a torsion rod 21, which extends in a vertical plane of symmetry 22 of the chair 1. The plane of symmetry 22 is also denoted as the xy-plane, and is located perpendicular to the drawing plane of FIG. 2, which shows the chair 1 from the direction of an arrow II provided in FIG. 1. The frame 4 is configured as a fixed frame. According to a variant, not shown, it is provided to design the frame 4 as a swivel frame with rollers in order to use the chair, for example, as an office chair. Between the support element 2 and the frame 3, a schematically shown resilient element 23 is arranged which holds the support element 2 in the resting position R1 shown in FIG. 1, and partially compensates for the loading of the support element 2 by a person seated on the support element 2, and permits a limited alteration of the position of the support element 2 relative to the frame 3 with correspondingly high loads. The above-described movement mechanism 3 is designed so that the inclination of the seat part and the inclination of the rear part are dependent on one another and the inclination of the rear part 9 between an initial position 9-1 shown in FIG. 1 and an end position 9-2 indicated by dashed lines, increases to a greater extent than the inclination of the seat part 8 between an initial position 8-1 shown in FIG. 1 and an end position 8-2 indicated by dashed lines. A relative movement which takes place between the seat part 8 and the rear part 9, when said parts are moved from their initial positions 8-1 and 9-1 into their end positions 8-2 and 9-2, is compensated by a deformation of the transition part 10, so that in spite of the permanent support element 2 a so-called synchronous mechanism 24 is produced in the chair 1. The torsional properties of the torsion element 11 come to bear when the person seated on the chair 1 does not lean centrally against the rear part 9 in the region of the plane of symmetry 22, but loads the rear part laterally, for example at a loading point 25. Such a loading of the support element 2 leads to a deformation of the support element 2, namely to torsion between the seat part 8 and the rear part 9. This torsion of the support element 2 is limited by the torsion element 11 and, in particular, the torsion rod 21, as said torsion rod creates a counter force, which is introduced via the fastening points 17 and 18 into the rear part 9, to this end the torsion element 11 being supported on the basic frame 4. Such a limited torsion of the support element 2 is possible, irrespective of the inclination of the rear part 9 of the support element 2, in any inclined position between the initial position 9-1 and the end position 9-2. The torsion rod 21 extends in the y-direction upwards beyond the lumbar support 19. The support element of the first variant shown in FIGS. 1 and 2, comprises two curved, L-shaped support members 26 and 27 and a cover 28 which is tensioned between the support members 26 and 27. The torsion element 11 and the levers 12 and 13 of the movement mechanism 3 in each case act on the support members 26 and/or 27. In the extension of the torsion rod 21, the torsion element 11 is configured as a pair of antler-like projections 29, which divide the torsion rod 21 towards the upper free ends 26*a* and 27*a* of the support members 26 and/or 27.

In FIG. 13, the chair 1 is additionally shown in an oblique view obliquely from the rear. It can be seen in this view how the two levers 12 and 13 form the second rocker 38 by means of a bow 37 connecting said levers. The movement mechanism 3 therefore essentially comprises the first rocker 14, the second rocker 38 and a basic body 41. Like the first rocker 14, the second rocker 38 has a rotational axis 39 and a rotational axis 40, on four rotational axes 15, 16 and 39, 40 all the movement mechanism 3 running parallel to one another. The first rocker 14 is not only articulated in the region of the rotational axis 15 on the support element 2 but is also connected to the latter by means of the support members 26, 27 thereof at the fastening points 17, 18. A free rotatability of the rockers 14, about the rotational axes 16, 40 is damped and restricted by a spring mechanism 42 which is incorporated into the basic body 41.

In FIGS. 3 and 4, a second variant of a chair 30 is shown in side view and rear view. Relative to this second variant, reference is initially made to the description of the first variant shown in FIGS. 1 and 2. Accordingly, similar components are denoted by the reference numerals used in FIGS. 1 and 2. In contrast to the first variant, the movement mechanism 3 essentially comprises just one torsion element 11 which is rigidly fastened between the seat part 8 of the support element 2 and the frame 4. This torsion element 11 comprises, in the same manner as the torsion element of the first variant, a torsion rod 21 which is divided in the manner of a pair of antler-like projections 29, and is fastened to the free ends 26*a* and 27*a* of the support members 26 and 27. In addition to its torsional properties, the torsion element 11 is still configured to be flexible and, as a result, cushions the rear part 9 of the support element 2 between the initial position 9-1 and the end position 9-2, to this end the transition region 7 of the support element 2 being elastically deformed. The movement mechanism also comprises a bearing element 48 with which the two support members 26, 27 are held at a predefined distance from one another.

FIGS. 5 and 6 show a third variant of a chair 31. Relative to this third variant, reference is initially made to the description of the first variant shown in FIGS. 1 and 2. Accordingly, similar components are denoted by the reference numerals used in FIGS. 1 and 2. In contrast to the first variant, the support element 2 in the third variant has no support members and no cover but a curved, L-shaped seat shell 32 which is molded, for example, from plastics material. The seat shell 32 is elastically deformable, in particular, in its transition region 7. Analogous to FIG. 13, FIG. 14 shows an oblique view of the chair 31 shown in FIGS. 5 and 6. Accordingly, reference is made here to the description of FIG. 13. The first rocker 14 is configured comparably to the first rocker of the first variant and is connected to the support element 2 at two points of articulation, but the points of articulation 17, 18 lie on the seat shell 32 instead of on support members.

FIGS. 7 and 8 show a fourth variant of a chair 33. Relative to this fourth variant, reference is initially made to the description of the first variant shown in FIGS. 1 and 2. Accordingly, similar components are denoted by the reference numerals used in FIGS. 1 and 2. In contrast to the first variant, the support element 2 in the fourth variant has no support members and no cover but a curved, L-shaped seat shell 32, which is molded, for example, from plastics material. The seat shell 32 is elastically deformable, in particular, in its transition region 7. Moreover, the movement mechanism 3 of the fourth variant comprises, in contrast to the movement mechanism of the first variant, only one torsion element 11 which is rigidly fastened between the seat part 8 of the support element 2 and the frame 4. This torsion element 11 comprises, in a similar manner to the torsion element of the first variant, a torsion rod 21 which is split in the manner of a pair of antler-like projections 29 and is fastened to the free ends 26*a* and 27*a* of the support members 26 and 27. In addition to its torsional properties, the torsion element 11 is still configured to be flexible and, as a result, cushions the rear part 9 of the support element 2 between the initial position 9-1 and the end position 9-2, to this end the transition region 7 of the support element 2 being elastically deformed.

FIGS. 9 and 10 show a fifth variant of a chair 34. Relative to this fifth variant, reference is initially made to the description of the first variant shown in FIGS. 1 and 2. Accordingly, similar components are denoted by the reference numerals used in FIGS. 1 and 2. In contrast to the first variant, the support element 2 in the fifth variant has no support members and no cover but a curved, L-shaped seat shell 32 which is molded, for example, from plastics material. The seat shell 32 is elastically deformable, in particular, in its transition region 7. Moreover, the seat shell 32 is not attached via a pair of antler-like projections of the torsion element 11 but is centrally fastened in the region of the plane of symmetry 22 to an extension 35 of the torsion rod 21. Analogously to FIG. 13 and to FIG. 14, FIG. 15 shows an oblique view of the chair 34 shown in FIGS. 9 and 10. Accordingly, reference is made here to the description of FIGS. 13 and 14. In a departure from the first rocker of the first and third variant, the first rocker 14 does not fork in the manner of a pair of antler-like projections but rather merely has a central point of articulation 18 in which the first rocker 14 is connected to the seat shell 32 of the chair 34.

FIGS. 11 and 12 show a sixth variant of a chair 36. Relative to this sixth variant, reference is initially made to the description of the first variant shown in FIGS. 1 and 2. Accordingly, similar components are denoted by the reference numerals used in FIGS. 1 and 2. In contrast to the first variant, the support element 2 in the sixth variant comprises no support members and no cover but a curved, L-shaped seat shell which is molded, for example, from plastics material. The seat shell 32 is elastically deformable, in particular, in its transition region 7. Moreover, the movement mechanism 3 of the sixth variant, in contrast to the movement mechanism of the first variant, comprises just one torsion element 11 which is fastened rigidly between the seat part 8 of the support element 2 and the frame 4. The seat shell 32 is not attached via a pair of antler-like projections of the torsion element but is centrally fastened in the region of the plane of symmetry 22 to an extension 35 of the torsion rod 21. In addition to its torsional properties, the torsion element 11 is still configured to be flexible, and as a result cushions the rear part 9 of the support element 2 between the initial position 9-1 and the end position 9-2, to this end the transition region 7 of the support element 2 being elastically deformed.

With reference to the schematic illustrations of FIGS. 1, 2 and 13, FIG. 16 illustrates the chair 1 described as the first variant together with structural details, the frame 4 being shown without rollers provided. A cover 28 is also only indicated as a hatched surface in order to obtain clarity. In addition to the support members 26, 27 and the cover 28, the support element 2 also comprises two spacer rods 43, 44 illustrated schematically. The spacer rods 43, 44 hold the two support members 26, 27 at a defined distance a43, a44 at the free ends 26*a*, 26*b* and 27*a*, 27*b* thereof (see FIG. 18) and thus ensure a high load-bearing capacity of the cover 28. A high load-bearing capacity of the cover 28 is furthermore ensured by the articulation of the support members 26, 27 on the movement mechanism 3. In the seat region 5, the support member 26 is articulated on the first rocker 14 via a first point of articulation A and on the second rocker via a second point of articulation B, which is concealed. In the seat region 5, the support member 27 is articulated on the first rocker 14 via a first point of articulation C and on the second rocker 38 via a second point of articulation D. Furthermore, the fastening points 17, 18, at which the forking torsion element 11 merges into the support members 26, 27, form two further points of articulation E and F. By means of such a four-point bearing of the seat region 5, during dynamic sitting torsion of the seat region 5 or rolling of the seat region 5 about a roll axis WA, which lies in the plane of symmetry 22 and extends in the x direction (see FIG. 2), is reliably avoided and it is ensured that the rear part 9 twists in relation to the seat region 5 with corresponding loading by the seated person. By means of an approximately X-shaped geometry of the torsion element 11 and of the first rocker 14, the movement mechanism 3 confers a high degree of stability on the chair 1 while simultaneously permitting a torsion-like twisting between the upper half 20 of the rear part 9 and the seat part 5, the torsion being made possible by elastic deformation of the torsion element 11, the support members 26, 27 and the cover 28. The torsion takes place in particular in the region of the lumbar support 19 and of the transition part 10. By means of the rotatable articulation of the first rocker 14 on the basic body 41 of the movement mechanism 3, with corresponding loading by the seated person the torsion element 11 permits the torsion-like twisting to be combined with the inclination movement of the rear part 9, which movement is indicated in FIG. 2 by the positions 9-1 and 9-2. The seat part 8 is connected in the front half 8*a* thereof, which is located close to the spacer element 44, to the second rocker 38 and in the rear half 8*b* thereof, which adjoins the front half 8*a* at the spacer element 43, to the first rocker 14. By this means, the support members 26, 27 are guided on the basic body 41 by two parallelogram guides P1 and P2 which are arranged in a mirror-inverted manner with respect to the plane of symmetry 22, the parallelogram guides P1, P2 being substantially formed by the two rockers 14 and 38 and operating synchronously.

In FIGS. 17 and 18 the chair 1 is shown perspectively in views from below, the frame, the spacer rods, the cover and the spring mechanism having been omitted from view. Two installation spaces 45, 46 for the spring mechanism (not illustrated) can be seen in the basic body 41. However, the spring mechanism (not illustrated) exclusively influences the inclination behavior of the chair 1. The torsional behavior of the chair 1 is influenced only by the torsion element 11 rather than the spring mechanism. It can be fully seen in FIG. 17 how the seat part 8 is suspended on the movement mechanism 3 by means of a four-point bearing 47 via the points of articulation A to D. Furthermore, it can be seen how the rear part 9, which is shown only with the support members 26, 27 and without the cover and spacer rod, is suspended on the movement mechanism 3 by means of a two-point bearing 49 via the points of articulation E and F.

FIG. 18 once again denotes the four parallel rotational axes 15, 16, 39 and 40 and the four free ends 26*a*, 26*b* and 27*a*, 27*b* of the two support members 26, 27.

With regard to FIGS. 16 to 18, reference is also made to the description of FIGS. 1, 2 and 13 with some of the reference numerals mentioned there also being noted in FIGS. 16 to 18.

A combining of the inclination movement and torsional movement is possible if the first rocker 14 is of X-shaped configuration or upside down y-shaped configuration, as shown in the fifth and sixth variant.

FIGS. 19 to 36 illustrate modifications of the six variants illustrated in FIGS. 1 to 12, in two side views and one rear view in each case. With regard to the basic construction and the basic functioning of the modifications shown in FIGS. 19 to 36, reference is correspondingly made to the description of FIGS. 1, 2 and 3, 4 and 4, 5 and 5, 6 and 7, 8 and 9, 10 and 11, 12. In contrast to the chairs shown in FIGS. 1 to 12, in all six chairs shown in FIGS. 19 to 36, 1*a* (see FIGS. 19 to 21), 30*a* (see FIGS. 22 to 24), 31*a* (see FIGS. 25 to 27), 33*a* (see FIGS. 28 to 30), 34*a* (see FIGS. 31 to 33) and 36*a* (see FIGS. 34 to 36), the rear part 9 is a first buckling device 50 (illustrated symbolically), and the torsion element 11 is a second symbolically illustrated buckling device 51, a lower section 52 of the rear part 9, which section adjoins the transition part 10, and an upper section 53 of the rear part 9, which section adjoins the lower section 52, being pivotably connected by the first buckling device 50. In this case, the first buckling device 50 is arranged below a region of articulation 54, in which the torsion element 11 is connected to the rear part 9. The second buckling device 51 formed in the torsion element 11 comprises a lower section 55 of the torsion element 11, which section is connected to a basic body 41 of the movement mechanism 3, and an upper section 56 of the torsion element 11, which section is connected to the rear element 9 in the region of articulation 54, the two sections 55, 56 being connected pivotably by the second buckling device 51. In the region of articulation 54, the upper section 53 of the rear part 9 and the upper section 56 of the torsion element 11 are connected to one another. The second buckling device 51 and therefore also the first buckling device 50 are formed above the lumbar support 19 of the chair 1*a*, 30*a*, 31*a*, 33*a*, 34*a* and 36*a*. In this case, the second buckling device 51 is arranged below the first buckling device 50.

The first buckling device 50 is preferably configured as a bending zone B50 which permits a type of buckling formation between the lower section 52 and the upper section 53 of the rear part 9 depending on in which position the chair 1*a*, 30*a*, 31*a*, 33*a*, 34*a* or 36*a* is in. In a resting position R1, as shown in FIGS. 19, 22, 25, 28, 31 and 34, the lower section 52 and the upper section 53 of the rear part 9 have a first angle of aperture α-R1 with respect to one another, the angle of aperture α-R1 lying in the plane of symmetry 22, which has already been described for the individual variants, and being measured between a surface 52*a* of the lower section 52 in contact with a seated person and a surface 53*a* of the upper section 53 in contact with a seated person. The resting position R1 is taken up by the chair 1*a*, 30*a*, 31*a*, 33*a*, 34*a* or 36*a* when said chair is unloaded or when a person sits on the chair in such a manner than the person exerts only a small pressure, if any at all, on the rear element 9 of said chair. In a reclined position R2, as shown in FIGS. 20, 23, 26, 29, 32 and 35, the lower section 52 and the upper section 53 of the rear part 9 have a second angle of aperture α-R2 with respect to one another, the angle of aperture α-R2 likewise lying in the plane of symmetry 22 mentioned. During the transition from the position R1 into the position R2, the two interacting buckling devices 50 and 51 of the rear part 9 and of the torsion element 11 cause a reduction in the angle of aperture from the value α-R1 to the value α-R2. The position which the two sections 52, 53 of the rear part 9 take up with respect to each other therefore changes in the manner of an easily closing flap. The upper section 53 of the rear part 9 moves forwards relative to the lower section 52 of the rear part 9 in the arrow direction x. That is to say, the upper section 53 of the rear part 9 moves relative to the lower section 52 of the rear part 9 during the inclination movement, which the chair 1*a*, 30*a*, 31*a*, 33*a*, 34*a* or 36*a* executes when a person seated on the chair 1*a*, 30*a*, 31*a*, 33*a*, 34*a*, or 36*a* leans back against the rear part 9, and in the process buckles forwards. Said movement, which is opposed to the inclination movement, which is directed in the arrow directions x' and y', stabilizes the neck and the head of the person seated on the chair 1*a*, 30*a*, 31*a*, 33*a*, 34*a* or 36*a*, depending on the shaping and the size of the upper section 53 of the rear part 9, and makes it possible for the person, in an ergonomically desirable manner, to maintain a viewing axis, which has been adopted in the position seated upright, during the reclining and in the reclined position, since the upper section 53 of the rear part 9, against the surface 53*a* of which the head of the person seated on the chair bears, inclines to a smaller extent between the position R1 and the position R1 than the lower section 52 of the rear part 9, against the surface 52*a* of which the upper body of the person seated on the chair leans. In this case, the second buckling device 51 is arranged below the first buckling device 50 in both positions R1 and R2 of the chair 1*a*, 30*a*, 31*a*, 33*a*, 34*a* or 36*a*.

The second buckling device 51 is preferably likewise configured as a bending zone B51 which permits a type of buckling formation between the lower section 55 and the upper section 56 of the torsion rod 11. Where the buckling formation is controlled by the movement mechanism 3, the part thereof is the buckling device 51. In a resting position R1, as shown in FIGS. 19, 22, 25, 28, 31 and 34, the lower section 55 and the upper section 56 of the torsion rod 11 have a first angle of aperture β-R1 with respect to one another, the angle of aperture β-R1 lying and being measured in the plane of symmetry 22, which has already been described for the individual variants. In a reclined position R2, as shown in FIGS. 20, 23, 26, 29, 32 and 35, the lower section 55 and the upper section 56 of the torsion element 11 have a second angle of aperture β-R2 with respect to one another, the angle of aperture β-R2 likewise being measured in the plane of symmetry 22. Owing to the fact that the upper section 56 buckles forwards in the x direction during the change from the position R1 into the position R2, the value of the angle of aperture is reduced from β-R1 to β-R2. The upper section 56 of the torsion element 11 therefore moves forwards relative to the lower section 55 of the torsion element 11 when a person seated on the chair 1*a*, 30*a*, 31*a*, 33*a*, 34*a*, or 36*a* leans back. The two buckling devices 50 and 51 therefore operate synchronously as a consequence of the connection of the upper sections 53 and 56 thereof in the region of articulation 54—and therefore a closing movement of the movement mechanism 3, to which the buckling device 51 and the upper section 56 of the torsion element 11 belong, is transmitted to the rear part 9 of the support element 2. Correspondingly, upon departing from the position R2 into the position R1, an opening movement of the lower and of the upper sections 55, 56 of the movement mechanism 3 takes place again and therefore, as a consequence of the coupling, an opening movement of the lower section 52 and of the upper section 53 of the rear part 9 also takes place again.

It is provided for the first buckling device 50 to arrange the latter approximately level with the uppermost thoracic vertebra of a person seated in the chair 1*a*, 30*a*, 31*a*, 33*a*, 34*a* or 36*a* in order optimally to support the neck and head of said person in a reclined seating position. Correspondingly, the rear part in the modifications shown in FIGS. 19 to 36 is dimensioned such that the upper section 53 of the rear part 9 lies level with a neck region or a neck and head region of a person seated on the chair.

In the modifications, which are shown in FIGS. 19 to 21 and 22 to 24, of the first and second variants, the first buckling device 50 is technically formed in the two support members 26, 27 by respective bending zones B50, configured as an elastic region, or alternatively by respective joint elements. The cover 28 follows the movement predetermined by the support members 26, 27 without additional adaptation.

In the modifications, which are shown in FIGS. 25 to 27, 28 to 30, 31 to 33 and 34 to 36, of the third to sixth variants, the first buckling device 50 is incorporated into the seat shell 32 forming the support element 2, and extends in a horizontal alignment over the rear part 9. The first buckling device 50 is formed by a bending zone B50, which is configured as an elastic region, or alternatively by a joint element.

In the modifications, which are shown in FIGS. 19 to 21, 22 to 24, 25 to 27 and 28 to 30, of the first to fourth variants, the second buckling device 51 is formed in the torsion element 11, or in the first rocker 14 which forms the torsion element 11, below the pair of antler-like projections 29, into which the torsion rod 21 forks in order to merge in the region of articulation 54 into the support members 26, 27. The second buckling device 51 is formed by a bending zone B51, which is configured as an elastic region, or alternatively as a joint element. The pair of antler-like projections 29 forms the upper section 56 of the torsion element 11. The pair of antler-like projections 29 is connected in particular in a planar manner to the support members 26, 37.

In the modifications, which are shown in FIGS. 31 to 33 and 34 to 36, of the fifth and sixth variants, the second buckling device 51 is formed in the torsion element 11, or in the first rocker 14 which forms the torsion element 11, below the central region of articulation 54, in which the rocker 14 is articulated on the seat shell 32. The second buckling device 51 is formed by a bending zone B51, which is configured as an elastic region, or alternatively by a joint element.

The invention is not limited to the exemplary embodiments shown or described. On the contrary, it comprises developments of the invention which lie within the scope of the protected claims.

The invention claimed is:

1. A chair comprising:

a fixed frame;

a support element coupled to the frame, the support element including a seat region forming a seat part, a rear region forming a rear part, and a transition region forming a transition part, the transition part connecting the seat part and the rear part, wherein the rear part is reclinable relative to the seat part by way of elastic deformation of the transition part; and a movement mechanism including a first rocker at least partly controlling movement of the rear part, a second rocker at least partly controlling movement of the seat part, and a basic body connecting the first rocker and the second rocker to the frame, wherein the first rocker is formed by a torsion element having a torsion rod extending in a vertical direction between the seat part and the rear part of the support element, the torsion rod capable of elastic deformation that enables a twisting behavior of the chair, wherein the first rocker is rotatably coupled to the basic body at a first axis of rotation and is rotatably coupled to a rear half of the seat part of the support element at a second axis of rotation, wherein the first rocker is coupled to the rear part of the support element exclusively above a lumbar support, and wherein the second rocker is rotatably coupled to the basic body at a third axis of rotation and is rotatably coupled to a front half of the seat part of the support element at a fourth axis of rotation.

2. The chair of claim 1, wherein the basic body includes a spring mechanism that dampens and restricts rotation of the first rocker and the second rocker.

3. The chair of claim 2, wherein the spring mechanism exclusively influences the inclination behavior of the chair, and wherein the twisting behavior of the chair is exclusively influenced by the torsion element.

4. The chair of claim 1, wherein the support element includes a pair of L-shaped support members.

5. The chair of claim 4, wherein the second rocker is formed by a pair of levers, each of the levers coupled to one of the L-shaped support members.

6. The chair of claim 4, wherein the second rocker further includes a bow connecting the pair of levers.

7. The chair of claim 4, wherein a cover is tensioned between the L-shaped support members, and wherein the support element further includes a spacer rod holding the L-shaped support members at a distance relative to one another, the spacer rod providing additional load bearing capacity to the cover.

8. The chair of claim 4, wherein the first rocker is formed by a torsion element, wherein the torsion element includes a pair of antler-like projections extending upward and outward, each antler-like projection coupled to one of the L-shaped support members on the rear part of the support element at a location above the lumbar support.

9. The chair of claim 1, wherein the rear part is movable between an initial position and an end position, wherein the seat part is movable between an initial position and an end position, and wherein the movement of the rear part is greater than the movement of the seat part.

10. A chair comprising:

a fixed frame;

a support element coupled to the frame, the support element including a first support member and a second support member, the first support member and the second support member each including a seat region forming a seat part, a rear region forming a rear part, and a transition region forming a transition part, the transition part connecting the seat part and the rear part, wherein the rear part is reclinable relative to the seat part by way of elastic deformation of the transition part; and a movement mechanism including a first rocker having a lumbar support and at least partly controlling movement of the rear part, a second rocker at least partly controlling movement of the seat part, and a basic body connecting the first rocker and the second rocker to the frame, wherein the seat part of the first support member is articulated on the first rocker via a first point of articulation and is articulated on the second rocker via a second point of articulation, wherein the seat part of the second support member is articulated on the first rocker via a third point of articulation and is articulated on the second rocker via a fourth point of articulation, wherein the rear part of the first support member is articulated on the first rocker via a fifth point of articulation that is located above the lumbar support of the first rocker, and wherein the rear part of the second support member is articulated on the first rocker via a sixth point of articulation that is located above the lumbar support of the first rocker.

11. The chair of claim 10, wherein the first point of articulation and the third point of articulation are located on a back half of the seat part, and wherein the second point of articulation and the fourth point of articulation are located on a front half of the seat part.

12. The chair of claim 11, wherein a first axis extends through the first point of articulation and the third point of articulation, and wherein a second axis extends through the second point of articulation and the fourth point of articulation.

13. The chair of claim 12, wherein the first axis and the second axis are parallel.

14. The chair of claim 10, wherein the first rocker is formed by a torsion element having a torsion rod extending in a vertical direction between the seat part and the rear part of the support element, the torsion rod capable of elastic deformation that enables a twisting behavior of the chair.

15. The chair of claim 14, wherein the torsion element is X-shaped.

16. The chair of claim 10, wherein the first support member and the second support members are L-shaped.

17. The chair of claim 10, wherein the second rocker is formed by a pair of levers, each of the levers coupled to one of the support members, and wherein the second rocker further includes a bow connecting the pair of levers.

18. The chair of claim 10, wherein a cover is tensioned between the support members, and wherein the support element further includes a spacer rod holding the support members at a distance relative to one another, the spacer rod providing additional load bearing capacity to the cover.

19. A method of constructing a chair including a frame, a support element, and a movement mechanism, the support element having a seat part, a rear part, and a transition part connecting the seat part and the rear part, the movement mechanism having a first rocker, a second rocker, and a basic body, the method comprising:

rotatably coupling the first rocker to the basic body, the first rocker including a torsion element having a torsion rod extending in a vertical direction between the seat part and the rear part of the support element, the torsion rod capable of elastic deformation that enables a twisting behavior of the chair;

rotatably coupling the second rocker to the basic body;

rotatably coupling the first rocker to the support element at a first location and a second location, the first location being on a back half of the seat part, the second location being on the rear part at a position above a lumbar support of the support element; and rotatably coupling the second rocker to the support element at a position on the front half of the seat part.

20. A chair comprising:

a fixed frame;

a support element coupled to the frame, the support element including a seat region forming a seat part, a rear region forming a rear part, and a transition region forming a transition part, the transition part being located between the seat part and the rear part and connecting the seat part and the rear part, wherein the rear part is reclinable relative to the seat part by way of elastic deformation of the transition part; and a movement mechanism including a first rocker at least partly controlling movement of the rear part, a second rocker at least partly controlling movement of the seat part, and a basic body being located beneath the seat part and connecting the first rocker and the second rocker to the frame, wherein the first rocker is rotatably coupled to the basic body at a first axis of rotation and is rotatably coupled to a rear half of the seat part of the support element at a second axis of rotation, wherein the first rocker is coupled to the rear part of the support element exclusively above a lumbar support, wherein the second rocker is rotatably coupled to the basic body at a third axis of rotation and is rotatably coupled to a front half of the seat part of the support element at a fourth axis of rotation, and wherein the support element includes a pair of L-shaped support members.

* * * * *